United States Patent [19]

Caiati

[11] Patent Number: 4,917,384

[45] Date of Patent: Apr. 17, 1990

[54] GOLF CLUB

[76] Inventor: Michael Caiati, P.O. Box 933, Evanston, Ill. 60204

[21] Appl. No.: 372,794

[22] Filed: Jun. 29, 1989

[51] Int. Cl.[4] ..... A63B 53/04

[52] U.S. Cl. ..... 273/175; 273/167 J

[58] Field of Search ..... 273/175, 167 J, 167 F, 273/168, 78, 173, 174, 175

[56] References Cited

U.S. PATENT DOCUMENTS 2,908,502 10/1959 Bradstreet et al. ..... 273/167 J 3,989,861 11/1976 Rasmussen ..... 273/167 J 4,768,787 9/1988 Shira ..... 273/175

FOREIGN PATENT DOCUMENTS 268181 7/1965 Australia ..... 273/167 J

*Primary Examiner*—George J. Marlo

*Attorney, Agent, or Firm*—Robert K. Rhea

[57] ABSTRACT

In a golf club having a driver head, the ball driving surface is provided with a planar smooth surface which is coated with a layer of granular material to provide a roughened surface for improving contact between the golf club head and a ball when struck for driving the latter down a fairway.

6 Claims, 1 Drawing Sheet

GOLF CLUB

BACKGROUND OF THE INVENTION

1. Field of the invention

The present invention relates to golf clubs and more particularly to the head of golf clubs having a ball driving surface thereon.

2. Description of the prior art

The prior art generally disclose golf clubs, particularly those referred to as drivers, both woods and irons with a generally planar ball contacting surface for driving a ball down a fairway. This ball contacting surface is characterized by a plurality of horizontal relatively shallow grooves, usually coextensive with the ball contacting surface and spaced vertically at least through the medial portion of the ball contacting planar surface.

This invention is an improvement over the planar grooved surface of a golf club head by providing a different type of ball contacting surface which, it is believed, provides a positive contact between the driving head and the point of contact with a ball imparting both lift and angular rotation of the ball to achieve a greater distance in its flight.

SUMMARY OF THE INVENTION

A conventional golf club head, whether it be an iron or wood, is provided with a planar surface for striking the ball in which the planar surface is smooth, no indentations or protrusions above the plane of the ball striking surface. This surface is then provided with a layer of granular material relatively fine and closely spaced resulting in a roughened sandpaper-like surface throughout the area or face of the club intended for striking a ball when driving the latter.

The principal object of this invention is to provide an improved golf club ball contacting surface for forming a firm contact between the golf club head and a golf ball when the golf ball is struck for driving it down a fairway.

DESCRIPTION OF THE PREFERRED EMBODIMENTS

Figure 1:
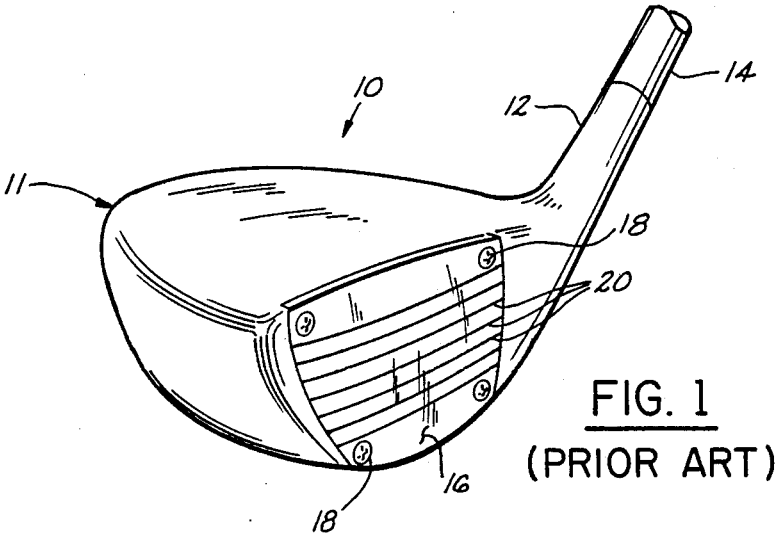
FIG. 1 (PRIOR ART)
FIG. 1 is fragmentary perspective view of a prior art golf club.

Like characters of reference designate like parts in those figures of the drawings in which they occur.

In the drawings:

The reference numeral 10 indicates a substantially conventional golf club having a head 11 and a shank 12 connected with a fragment of an elongated handle 14. The driving face of the head 11 is provided with a generally planar polyagonal-shaped plate 16 which is recessed into the driving surface of the head 11 and secured thereto, as by screws 18. The surface of the plate 16, opposite the golf club head 11, is horizontally grooved, as indicated by the lines 20, and are coextensive with the width of the plate 16 and are vertically spaced throughout substantially the medial portion of the plate. The purpose of these grooves being to grip a spherical portion of a golf ball when the golf club is forcibly brought into contact with a golf ball when mounted on a tee, neither being shown.

The above description of a golf club head is substantially conventional and forms no part of the invention other than to set forth the combination with which the present invention is used.

Figure 2:
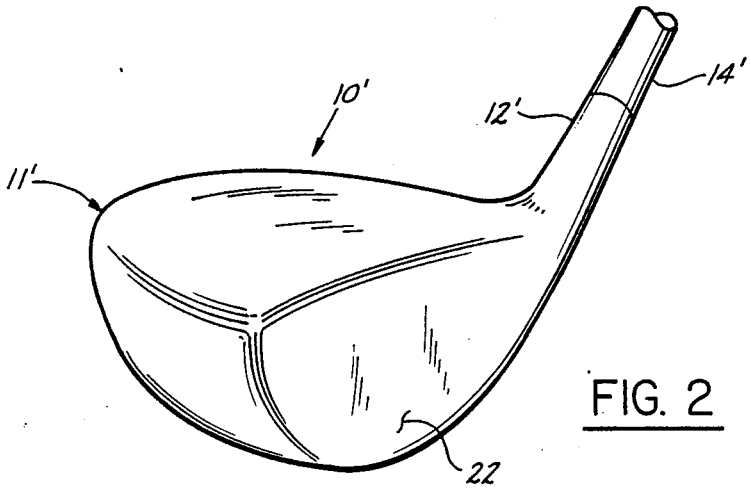
FIG. 2 is a view similar to FIG. 1 illustrating a planar golf ball driving smooth surface intended for striking a golf ball; and, FIG. 3 is a similar perspective view illustrating the improved golf ball contacting surface on the ball driving surface of the club head.
Figure 3:
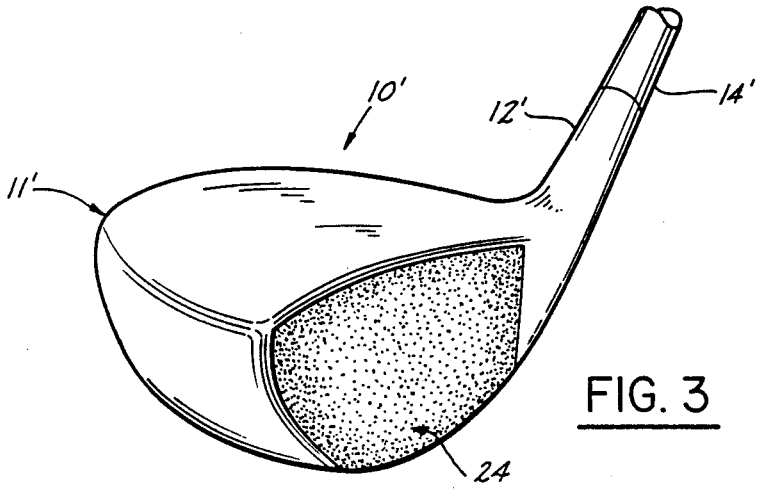

The improved golf club 10' (FIG. 2) having a head 11' similarly includes a shank portion 12' attached to a fragment of a handle 14'.

The driver face 22 of the golf club 10' is smooth without recesses, indentations or protrusions. The plane of the driving face 22 is shown vertical but may be inclined with respect to the surface of the earth, as a golf club iron, when held in playing position by a golfer. This smooth surface 22 is provided with a coat of granular material, indicated generally at 24. The granular material is bonded to the golf club head surface 22 by any suitable bonding agent.

For example, the bonding agent may be a liquid or gel which coats the surface 22 and the granular material 24 sprinkled or scattered thereon in any convenient manner so that when the bonding agent sets or hardens the granular material is fixed to the golf club face or surface 22.

The granular material is preferably relatively small, for example, micron size and is preferably small particles of industrial diamonds or may be the material, as it is sometimes called, "diamond dust". The finished surface must provide a surface with texture which will prevent any sliding or slipping of the ball relative to the granular surface 24 when the golf head strikes a golf ball. The surface as shown on the head 11' will impart a better driving force on the ball for a greater distance and on a golf club iron imparts an angular spin on the golf ball in addition to giving it added distance in its flight and aids the golfer in accurately controlling the direction of travel of the ball.

Obviously, the granular layer 24 may be formed as a separate layer of material having an adhesive surface which is cut to size and then applied to the surface of the golf club.

Obviously the invention is susceptible to changes or alterations without defeating its practicability. Therefore, I do not wish to be confined to the preferred embodiment shown in the drawings and described herein.

I claim:

1. In a golf club having a head portion and having a golf ball contacting smooth planar face surface, the improvement comprising:

a layer of closely spaced granular material bonded to said smooth surface for retarding sliding movement of a golf ball relative to said surface and inducing angular rotation of the ball when struck by said head.

2. The combination according to claim 1 in which the granules of said granular material are nonuniform in size and characterized by irregular surfaces.

3. The combination according to claim 2 in which said granular material comprises diamond particles.

4. The combination according to claim 3 in which the granular material particles are micron size.

5. In a golf club having a head portion and having a golf ball contacting smooth planar face surface, the improvement comprising:

a layer of closely spaced granular material including diamond particles bonded to said smooth surface for retarding sliding movement of a golf ball relative to said surface and inducing angular rotation of the ball when struck by said head.

6. In a golf club having a head portion and having a golf ball contacting smooth planar face surface, the improvement comprising:

a layer of diamond dust bonded to said smooth surface for retarding sliding movement of a golf ball relative to said surface and inducing angular rotation of the ball when struck by said head.

* * * * *